US006079304A

United States Patent [19]

Bisceglia

[11] Patent Number: 6,079,304

[45] Date of Patent: Jun. 27, 2000

[54] PINCH BLADE TOOL AND METHOD FOR PATTERNING ASPHALT SHINGLES WITH INDENTATIONS

[75] Inventor: James David Bisceglia, Pleasant Valley, N.Y.

[73] Assignee: Wondebar Construction Corporation, Pleasant Valley, N.Y.

[21] Appl. No.: 09/060,082

[22] Filed: Apr. 14, 1998

[51] Int. Cl.[7] ..... B26D 3/08

[52] U.S. Cl. ..... 83/51; 83/647; 83/920

[58] Field of Search ..... 83/630, 633, 634, 83/635, 920, 51, 647, 646, 628

[56] References Cited

U.S. PATENT DOCUMENTS

| | | | |
|---|---|---|---|
| 326,916 | 9/1885 | Morse . | |
| 600,856 | 3/1898 | Brinkman . | |
| 1,513,640 | 10/1924 | Shaw | 83/605 |
| 1,524,823 | 2/1925 | Henesey | 83/630 |
| 1,805,163 | 5/1931 | Buckner . | |
| 1,814,151 | 7/1931 | Gundlach . | |
| 1,818,397 | 8/1931 | Hurst | 83/628 |
| 1,906,599 | 5/1933 | Hoffert | 83/605 |
| 2,712,169 | 7/1955 | Buttress | 83/628 X |
| 2,779,325 | 1/1957 | Beckham | 83/605 |

*Primary Examiner*—M. Rachuba
*Assistant Examiner*—Dominic Troiano
*Attorney, Agent, or Firm*—Graham S. Jones, II

[57] ABSTRACT

A shingle trimming tool comprises a stationary and and a movable blades with edges. When a manually operated lever is lowered, the movable blade is mounted to reciprocate towards a closed position with the edges in contact and returns to an open position. The blade moves with a sliding action in which the reciprocating edge is driven into confrontation with the stationary edge to pinch work between the blades. When the lever is raised, then the movable blade slides back to an open position. The fixed blade and a pair of matched bell cranks are supported by a frame. The movable blade is supported by the bell cranks which hold the sharp edge of the movable blade parallel to the sharp edge of the lower blade during the entire reciprocal path traversed from open to closed position and back to the open position. The lever is connected to links provides leverage to force the movable blade down into contact with the stationary blade.

20 Claims, 5 Drawing Sheets

PINCH BLADE TOOL AND METHOD FOR PATTERNING ASPHALT SHINGLES WITH INDENTATIONS

BACKGROUND OF THE INVENTION

1. Field of the Invention

This invention relates to roofing shingle trimming tools, and more particularly to tools for patterning laminated asphalt roofing shingles.

2. Description of Related Art

For many years, standard asphalt shingles were made from a single layer. Such standard asphalt shingles are normally patterned by cutting them with a standard utility knife which is a manual (hand-held) tool. Standard asphalt shingles can be cut relatively easily by making a single score (cut) into the back side of the shingles, with the blade extending through the shingles from back to front. They are cut from the backside, because the front side is coated with abrasive material which rapidly dulls utility knife edges.

Contemporary laminated roofing shingles are quite popular in the contemporary market for roofing shingles. The laminated roofing shingles are constructed from a pair of layers of material, which when scored (cut) with a standard utility knife or any other commercially available knife requires multiple scores (usually three or four scores) that quickly dull the knife point of the utility knife or other types of commercially available knives. The reason for quickly dulling the knife point is that one must cut through one layer of granular asphalt before scoring the back of the second layer.

The temperature conditions during cutting shingles outdoors vary from extremely cold to very hot temperatures. As the ambient temperature changes, the properties of the shingles change from being very hard and nearly impossible to cut with a utility knife to being very soft at high temperatures and relatively easy to cut with a utility knife. In the case of laminated shingles these highly variable environmental conditions result in exaggeration of the temperature effect, but even hot and soft laminated shingles still require a good deal of effort to score the shingles.

U.S. Pat. No. 1,814,151 of Gundlach for a "Shingle Cutter" describes a stationary lower knife blade provided with a beveled cutting edge. There is an upper blade which is secured for vertical swinging movement towards and away from the stationary lower knife blade. The upper blade has a longitudinal V-shaped cutting edge disposed in vertical alignment with the cutting edge of the stationary lower knife blade. The upper blade is secured to the body of the tool at a pivot point at one end of both the upper blade; and the lower blade is secured for rotation of the upper blade towards and away from the lower blade. A lever is secured to the distal end of the upper blade and the support of the lower blade.

U.S. Pat. No. 326,916 of Morse dated Sep. 22, 1885 for a "Paper Cutting Machine" a machine for cutting paper with a movable knife secured to a cutter-bar hinged to brackets by a pair of pitmen. When the cutter-bar is actuated a draw cut is provided. There is no description of anything below the paper being cut other than a table so it appears that the knife cuts the paper without any interaction with a lower blade.

U.S. Pat. No. 600,856 of Brinkman issued in 1898 for a "Tile Cutting Machine" shows an arrangement for cutting tiles, presumably rigid ceramic tiles, in which an upper blade with serrated teeth is secured for vertical motion down towards a lower blade with serrated teeth which "wedge into and divide the tile without chipping or breaking . . ." the tile.

U.S. Pat. No. 1,805,163 of Buckner issued in 1935 for a "Belt Cutter" shows an anvil plate with a V-shaped groove. The cutter blade has a matching V-shape cross-section which appears to match and fit into the V-shaped groove. A camming action of cam abutments 16 and stops 28 drive the blade laterally when it reaches proximity to the anvil plate. The text is silent on the blade shape, stating that "the co-acting bevelled surfaces between the parts 16 and 28 allow the blade to feed itself nicely and smoothly in the groove of the anvil plate 10." Thus the cutter blade severs the work placed over the anvil plate with a sliding action, without the cooperation of a lower blade.

SUMMARY OF THE INVENTION

In accordance with this invention a shingle trimming tool comprises a stationary blade with a stationary edge, and a movable blade with a reciprocable edge with means for supporting the stationary blade and the movable blade. The movable blade is mounted for movement towards a closed position in contact with the stationary blade and away therefrom into an open position with a sliding action providing movement of the reciprocable edge into confrontation with the stationary edge for pinching work between the stationary blade and the movable blade.

Preferably, the means for supporting includes a pair of matched cranks with a front crank and a rear crank pivotably secured to the movable blade; and the upper blade remains parallel to the lower blade during the entire reciprocal path traversed from open to closed position and back to the open position.

Preferably, a support frame includes an upper support member and a lower support member. The front crank and the rear crank are secured for cranking relative to the upper support member. The stationary blade is secured to the lower support member, and the front crank is rotatably secured to the upper support member by a first fulcrum pin, and the rear crank is rotatably secured to the upper support member by a second fulcrum pin. Each of the front bell crank and the rear crank has an upper leg and a lower leg connected together at a joint disposed at an angle, including as follow:

a) an upper cranking leg with a cranking end formed on the proximal end of the cranking leg, b) a fulcrum bearing hole located proximate to the joint with the corresponding one of the fulcrum pins located within the fulcrum bearing hole, and c) a lower cranked leg with output end on the distal end thereof.

The first fulcrum pin and the second fulcrum pin are spaced apart by a predetermined distance along the second support member. Each of the proximal ends is mounted rotatably to spaced apart points along a cranking linkage. Each of the distal ends is pivotably mounted by bearing pivot pins to the movable blade at pivot points spaced apart by the predetermined distance.

Preferably, the means for supporting includes a pair of matched cranks with a front crank and a rear crank pivotably secured to the movable blade, each of the cranks including an upper arm and a pair of lower arms secured rotatably to the movable blade, with the lower arms straddling the movable blade. An actuating lever for the tool is secured to the means for supporting. A matched pair of balanced linkages is connected to opposite sides of the lever and to opposite sides of the cranks for transmitting force from the lever to the movable blade with balanced force vectors, whereby forces tending to rack the movable blade away from direct confrontation with the stationary blade is avoided.

Preferably there is means for preventing deflection of the blades comprising first, a reinforcement bar (preferably an angle bar) for the movable blade and second, sandwiching of the stationary blade between frame members of the means for supporting. Thus the blades have the stationary edge and the reciprocable edge in confrontational alignment when the blades are in the closed position.

In accordance with another aspect of this invention, a method is provided for making and operating a shingle trimming tool comprises the following steps. First, provide a stationary blade with a stationary edge. Provide a movable blade with a reciprocable edge. Support the stationary blade and the movable blade on a frame with the movable blade having mounted for movement towards and away from the stationary blade with a sliding action providing movement of the reciprocable edge into confrontation with the stationary edge for pinching work between the stationary blade and the movable blade.

Preferably, pivotably secure the movable blade to means for supporting with a pair of matched cranks including a front crank and a rear crank; provide a support frame including an upper support member and a lower support member; secure the front crank and the rear crank for cranking relative to the upper support member; secure the stationary blade to the lower support member; rotatably secure the front crank to the upper support member by a first fulcrum pin; and secure the rear rotatably to the upper support member by a second fulcrum pin.

Preferably, the means for supporting includes a pair of matched cranks including a front crank and a rear crank pivotably secured to the movable blade.

In this aspect of the invention also, each of the cranks includes an upper arm and a pair of lower arms secured rotatably to the movable blade, the lower arms straddling the movable blade, an actuating lever for the tool secured to the means for supporting.

A matched pair of balanced linkages is connected to opposite sides of the lever and to opposite sides of the cranks for transmitting force from the lever to the movable blade with balanced force vectors, whereby forces tending to rack of the movable blade away from direct confrontation with the stationary blade is avoided.

Preferably, the method includes providing means for preventing deflection of the blades comprising a reinforcement bar (preferably an angle bar) for the movable blade and sandwiching of the stationary blade between frame members of the means for supporting, whereby the blades have the stationary edge and the reciprocable edge in confrontational alignment when the blades are in the closed position.

Preferably, the method includes forming the frames from right angle cross-section metal members.

BRIEF DESCRIPTION OF THE DRAWINGS

The foregoing and other aspects and advantages of this invention are explained and described below with reference to the accompanying drawings, in which.

DESCRIPTION OF THE PREFERRED EMBODIMENT

I have observed that when a conventional cutter mechanism with bypassing shearing blades is used to cut shingles, the blades gum up, due to the gummy nature of asphalt shingles, when the are hot, in a way which makes them very difficult to use, so a different approach needs to be taken.

The asphalt shingle pinch blade tool 10 of this invention is adapted for facilitating the patterning and segmentation of laminated asphalt shingles without the problems of requiring repeated scoring leading to blade dulling as well as the gumming of the blades.

After study of the problems of cutting laminated asphalt shingles, I have discovered that a pinch blade arrangement makes it possible to indent laminated asphalt shingles and split them without a shearing action. In addition, I have also discovered that a pinch blade tool 10 made in accordance with this invention provides a sliding action of the pinch blades, which has a pinching/sliding action that overcomes the problem of gumming which provides what I have discovered to provide a built-in self-cleaning action.

Figure 1A:
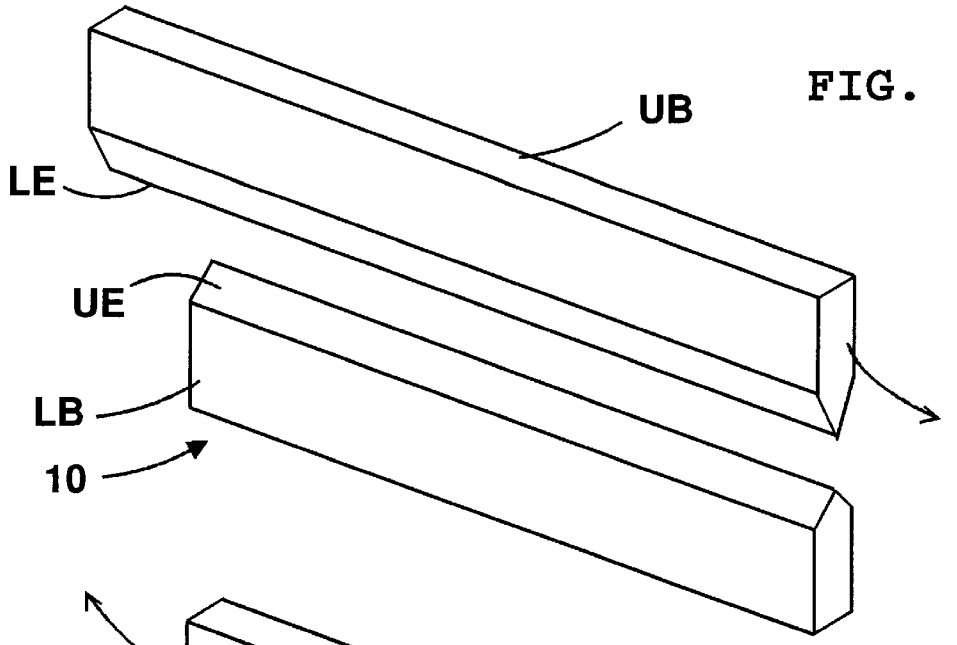
FIGS. 1A and 1B show schematic, perspective views of a pair of blades and of a pinch blade tool in open and closed positions respectively, in accordance with this invention.
Figure 1B:
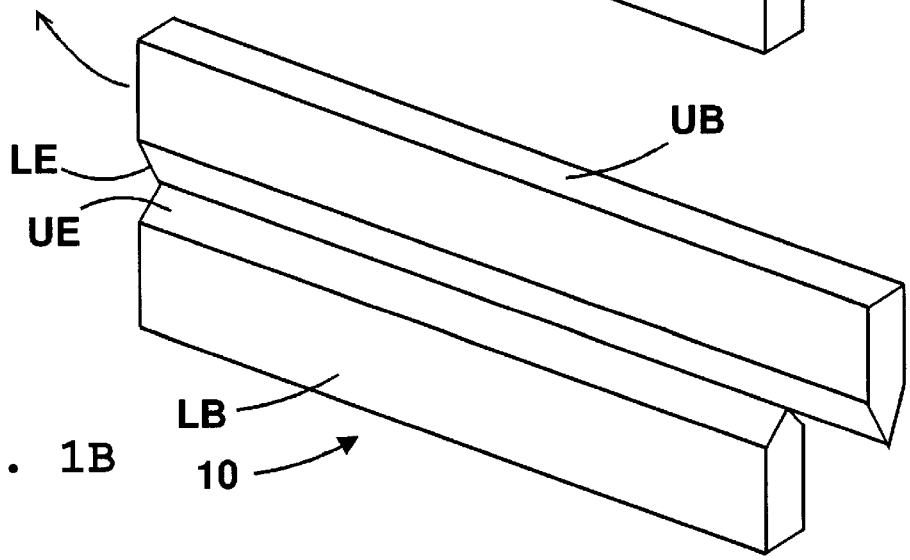
Figure 4A:
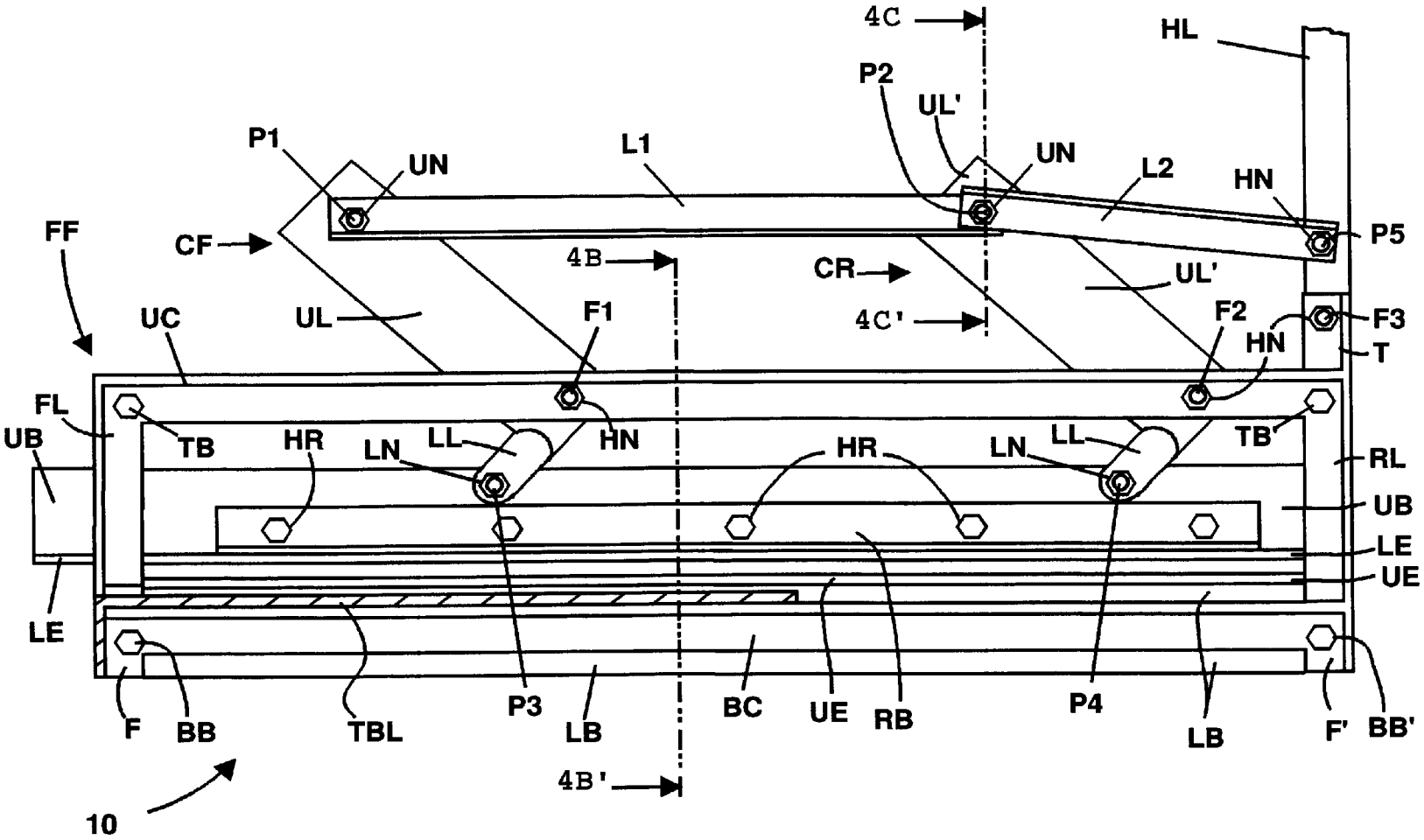
FIG. 4A shows a side elevational view of an embodiment of the tool of FIGS. 1A and 1B with the blades in the open position, in accordance with this invention.

FIGS. 1A and 1B show schematic, perspective views of a pair of blades UB and LB of a pinch blade tool 10 in open and closed positions respectively, in accordance with this invention. FIG. 1A shows the blades UB, LB of tool 10 in the open blade position. FIG. 1B shows the blades UB, LB of tool 10 in the closed blade position including a movable upper blade UB above a stationary lower blade LB which is held in fixed position, as shown in FIG. 4A.

Figure 2A:
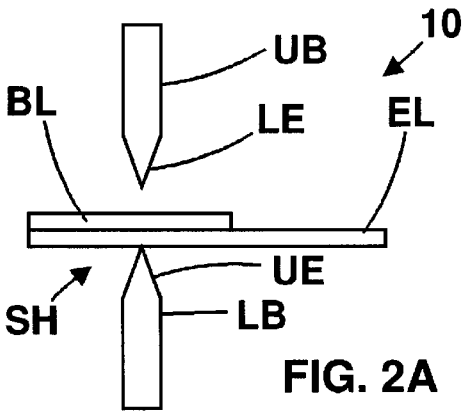
FIGS. 2A and 2B show end views of the lower blade and upper blade of the tool of FIGS. 1A and 1B with a laminated shingle between the two blades.
Figure 2B:
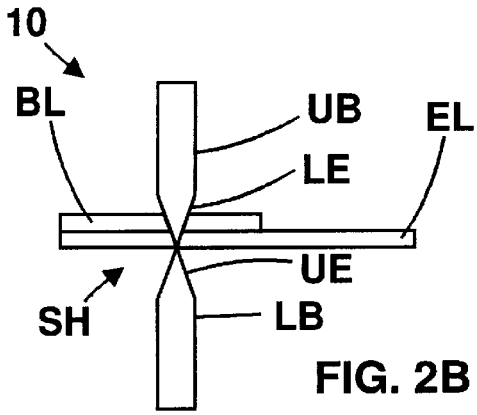

FIGS. 2A and 2B show end views of the lower blade LB and upper blade UB of tool 10 of FIGS. 1A and 1B with a laminated shingle SH between the two blades. The shingle SH includes an exterior layer EL and a back layer BL laminated/bonded to the exterior layer EL.

Referring again to FIGS. 1A and 1B, the upper blade UB is moved along the arcs indicated by the curved arrows shown in the drawings by an improved actuator mechanism incorporated in the shingle tool 10 (described in detail below) in accordance with this invention. The tool 10 has the capacity to produce clean and straight angle indentation lines impressed into a shingle SH (FIGS. 2A and 2B. During the combined vertical pinching motion along a perpendicular path towards the edge of the stationary blade) and horizontal sliding (transverse, sideways) motion along an arcuate path parallel to the edge of the stationary blade; from left (FIGS. 1A and 2A) to right (FIGS. 1B and 2B) of the upper blade UB comes down until the lower edge LE thereof is driven into contact with the shingle SH and is driven down until it closes against the upper edge UE of lower blade LB (FIGS. 1B and 2B), where a shingle SH such as the one seen in FIGS. 2A and 2B is to be bisected into two usually unequal parts.

The tool 10 of this invention provides the additional advantages of speed, safety and ease of use. The design and construction of the asphalt shingle pinch blade tool 10 of this invention is simple enough to permit easy serviceability and lends itself to dealing with the inherent problems found in a roofing job involving laminated shingles.

In FIG. 1A, the fixed lower blade LB is shown with a upper edge UE having a blade angle facing upwardly. The aligned, reciprocably slidable, upper blade UB is shown with a lower edge LE having a blade angle facing downwardly. The two blades LB and UB are disposed with the edges LE and UE confronting each other in a parallel orientation (with the blades LB and UB also being oriented in parallel), as can be seen in the end views of the blades of FIGS. 1A and 1B, respectively seen in FIGS. 2A and 2B.

A set of force-compounding members comprise the levers and balanced linkage mechanisms of this invention which provide a novel combination of basic mechanisms to provide a new tool design and the new dynamics of the method of operation of the tool 10.

The primary difference between the pinch blade shingle indenting and splitting tool 10 of this invention and prior art shingle cutters known heretofore is in the configuration of the pinch blades LB and UB, the reciprocal motions of the upper blade UB and the design and motion of the actuator mechanisms. An important part of the design is the fact that the upper blade UB remains parallel to the lower blade LB during the entire combined transverse and perpendicular arcuate reciprocal path traversed from open to closed position and back to the open position.

The blade design comprises a very simple pair of straight steel blades UB and LB with a lower edge LE on the lower side of the upper blade UB and an upper edge UE on the upper side of the lower blade LB. The upper edge UE and lower edge LE are preferably ground into a 60° V-shape cross-section which provides the pinch blade tool 10 the capacity to indent and split an asphalt shingle SH, without any scissor action in that the blades UB, LB confront each other and pinch together as the upper blade UB slides into contact with lower blade LB without any overlapping. When the blades UB, LB are fully engaged in contact, the shingle SH is pinched along a pattern line where the shingle thickness is reduced to a minimum thickness or split apart by indentation along the pattern line.

Referring again to FIGS. 2A and 2B, end views are shown of the lower blade LB and upper blade UB of tool 10 and a shingle SH (typically 12" wide by 36" in length which has varying thicknesses. For the purposes of illustration, shingle SH is shown with a width which has been shortened substantially, simply to illustrate the lamination of the shingle SH. Normally the shingle SH would be split along the 12" width, but may also be cut diagonally for roof hips and valleys.

FIG. 2A shows the blades LB and UB in an open blade position with the shingle SH ready to be indented by blades UB and LB of tool 10.

FIG. 2B shows the blades LB and UB in a closed blade position after the upper blade UB has been forced to slide down into contact with blade LB thereby indenting and splitting the shingle SH in accordance with the method of this invention.

Figure 3A:
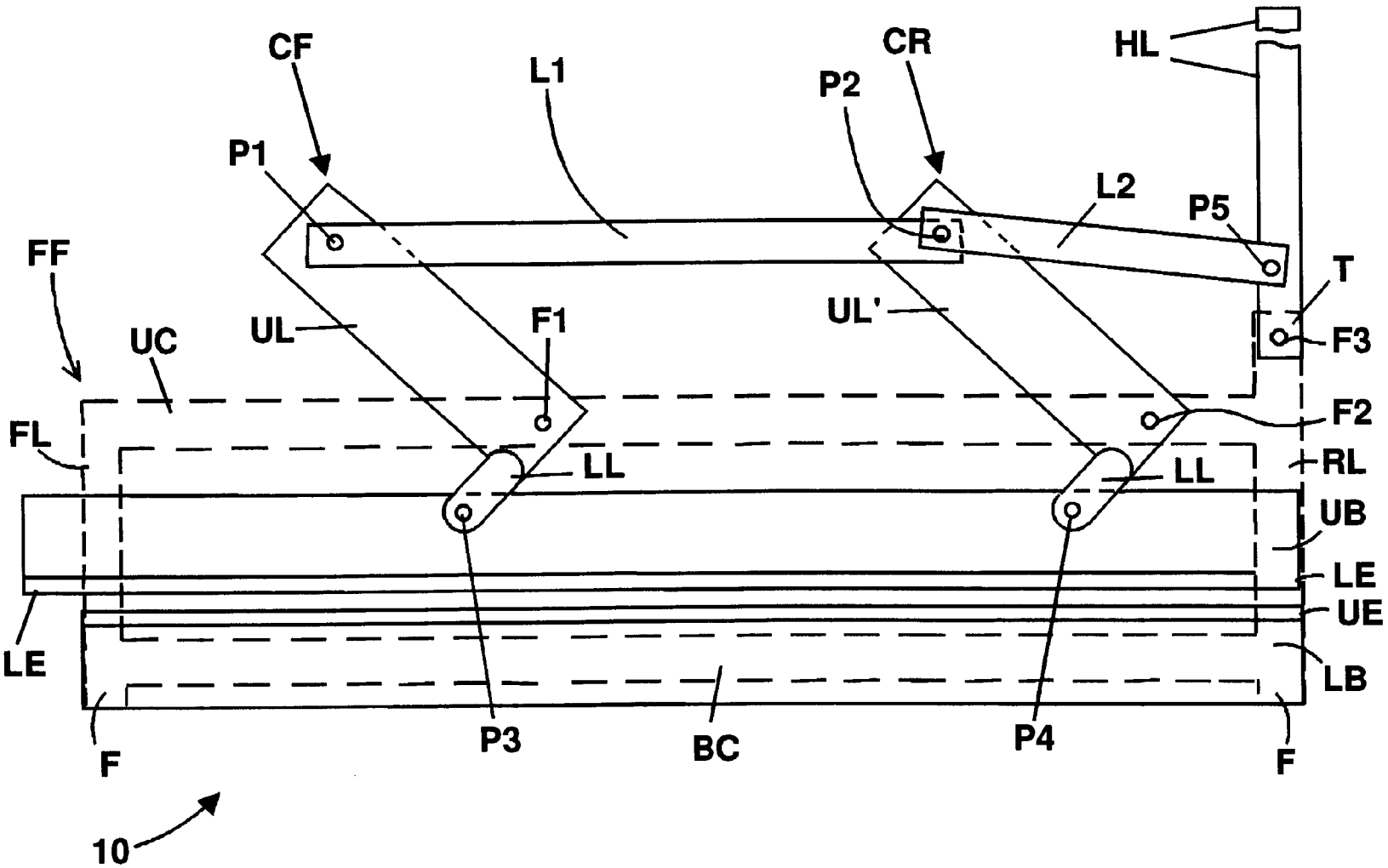
FIGS. 3A and 3B show side elevational views of an embodiment of the tool of FIGS. 1A and 1B with the blades in open and closed positions respectively, in accordance with this invention with the frame shown in phantom and the table omitted for convenience of illustration.
Figure 3B:
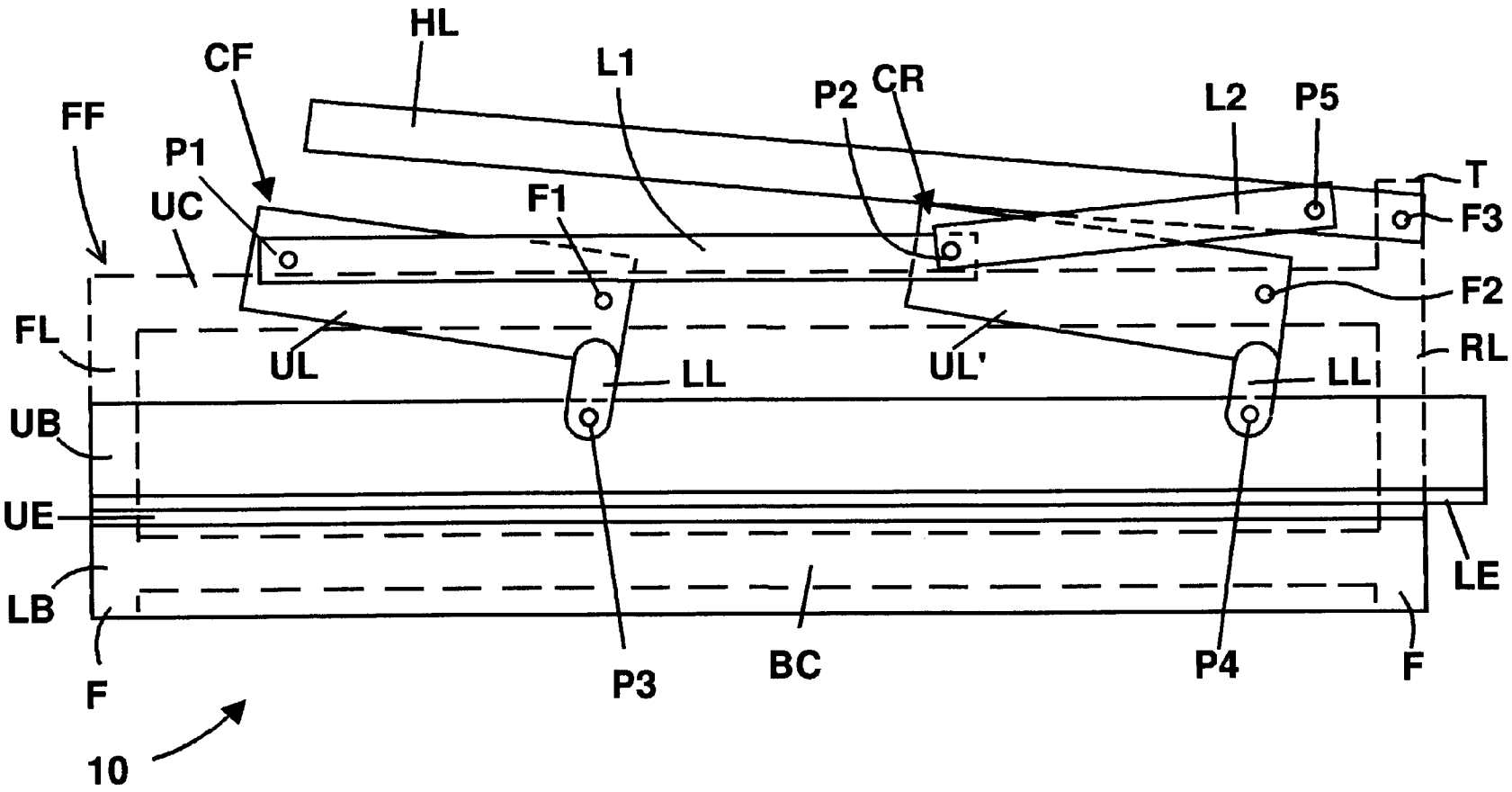

FIGS. 3A and 3B are schematic drawings of one side of the tool 10 showing, in phantom, one of a matched pair of rigid frames FF which are the basic supports for tool 10. The matched pair of rigid frames FF are located with one on each side of the blades UB and LB. The matched pair of rigid frames FF are a pair of rectangular structural members which support lower blade LB rigidly and support the upper blade UB for movement relative to lower blade LB. The two matched rigid rectangular frames FF hold the lower blade LB in fixed position.

Frames FF also support a set of mechanisms which are employed to support and to control the movements of the upper blade UB relative to the lower blade LB in the compound pinching and sliding action of the lower blade LB. In particular, upper blade UB is supported for a swinging motion from the upper left to the lower right. Upper blade UB is supported by pins P3 and P4 which connect it to the lower legs LL of a front and rear pair of steel bell cranks CF and CR, which are supported on fulcrum pins (threaded steel shoulder bolts) F1 and F2 secured to the upper cross members UC of the frames FF. Shoulder bolts are used to reduce friction. In this way, the upper blade UB can be driven down to indent and split a shingle SH being trimmed. This is a unique and important feature of this invention.

Each of the frames FF is shown to be formed of four rigid members (preferably made in a single casting of a light weight metal such as aluminum, with a right angle cross-section). The four rigid members which form a frame FF comprise a bottom cross member BC, an upper cross member UC, a front leg FL and a rear leg RL. The upper cross member UC and bottom cross members BC are the upper and bottom parallel members of the rectangular frames FF. Front leg FL and rear leg RL are the left and right parallel members of each of the rectangular frames FF of tool 10, as seen in FIGS. 3A and 3B. At the bottom of each of the front legs FL and rear legs RL, RL' is a foot F which extends to the bottom of the lower blade LB. Thus, as shown in FIGS. 3A and 3B, for each frame FF, the bottom cross member BC and upper cross members UC are connected by front leg FL on the left of FIGS. 3A and 3B and by rear leg RL on the right of FIGS. 3A and 3B.

The support and actuation of the upper blade UB are provided by the double crank suspension and actuation mechanism which supports the upper blade UB pivotably from the front bell crank CF and the rear bell crank CR. This arrangement creates a reciprocating swinging motion, down to the right or up to the left in FIGS. 3A and 3B. This slides blade UB laterally to the left while lifting upper blade UB. The upper blade UB is connected by crank pins (threaded steel shoulder bolts) P3 and P4 respectively to the lower legs LL of front crank CF and rear crank CR.

The upper blade UB is swung down from its open position in FIG. 3A to its closed position in FIG. 3B in response to the manually actuated counterclockwise lowering of the actuator handle HL. Handle HL has been cut away in FIG. 3A for convenience of illustration. Handle HL is secured, rotatably, at its lower end by a fulcrum pin (threaded steel shoulder bolt) P5 to the top end T of right legs RL of the matching pair of rigid frames FF. Top end T extends high enough above upper cross member UC to provide good leverage upon the cranks CF and CR by transmitting force through a matched pair of rotating balanced steel links L2, L2' and a matched pair of reciprocating balanced steel angle bar links L1 and L1'.

The crank pin (threaded steel shoulder bolt) P5 passes through handle HL, washers W (seen in FIG. 6) and a matched pair of balanced, rotating steel angle bar links L2, L2'. The crank pin P5 is located a slight distance up the lever arm of handle HL and the crank pin (threaded steel shoulder bolt) P5 connects to the proximal (right hand) end of rotating balanced links L2, L2'. On the distal (left) ends of rotating balanced links L2, L2' the crank pin (threaded steel shoulder bolt) P2 connects the distal (left) ends of rotating balanced links L2, L2' as well as the proximal end of the upper leg UL' of rear crank CR and to the proximal (right) ends of the horizontally oriented, reciprocating balanced links L1, L1'. The distal (left) ends of reciprocating balanced links L1, L1' are connected by crank pin (threaded steel shoulder bolt) P1 to the proximal end of the upper leg UL of front crank CF. To summarize, the tool 10 includes seven bearing pins with three fulcrum pins F1, F2, F3, and four additional linkage pins P1, P2, P3 and P4 which together with the balanced links and the frames and the bearing holes extending therethrough form bearings for the tool 10.

In operation, referring to FIGS. 3A and 3B, in FIG. 3A the handle HL is gripped at the upper end and is rotated about fulcrum pin (threaded steel shoulder bolt) F3 counterclockwise to crank the rotating link L2 counterclockwise by a reduced radius with the great mechanical advantage of the shorter lever arm from fulcrum pin (threaded steel shoulder bolt) F3 to crank pin (threaded steel shoulder bolt) P5 along handle HL. The rotating link L2 drives the two bell cranks CR and CF counterclockwise, with the horizontally oriented reciprocating link L1 driving the crank CF as it moves lower towards the upper cross member UC. Bell cranks CF and CR connect respectively through their lower legs LL, LL' and pins P3 and P4 to drive the upper blade UB down and to the right in a swinging motion into the position shown in FIG. 3B, with the lower edge LE of upper blade UB shown after it has been forced down into confronting contact with the upper edge UE of lower blade LB. The contact is made by the sharp points of the V-shaped lower edge LE and the matching and aligned V-shaped upper edge UE, as in FIG. 2B.

In summary, as to the operation of the bell cranks CF and CR, both the front crank CF and rear crank CR rotate in unison about fulcrum pins (threaded steel shoulder bolts) F1 and F2 relative to the frames FF, the upper blade UB is lifted and (driven down) lowered vertically, while sliding horizontally back and forth. When the cranks CF and CR rotate counter-clockwise as seen from the points of view of FIGS. 3A and 3B, the upper blade UB is forced down and to the right to close the blades UB and LB of tool 10. When the cranks CF and CR rotate clockwise, the upper blade UB is lifted up and to the left to open the blades UB and LB of tool 10.

Figure 5A:
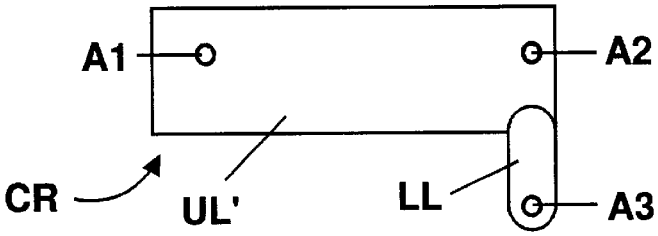
FIG. 5A shows a side elevational view of an embodiment of one of the bell cranks of FIG. 4A in accordance with this invention.
Figure 5B:
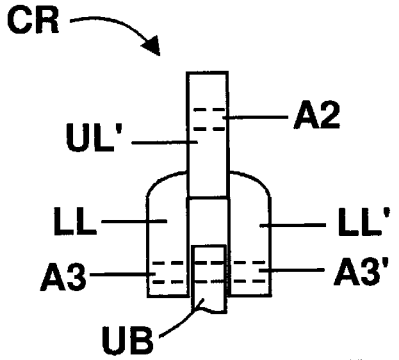
FIG. 5B shows an end elevational view of the bell crank of FIG. 5A with a portion of the upper blade between the legs of the bell crank.

Referring to FIGS. 5A and 5B, the lower legs LL, LL' of cranks CF and CR have a wishbone configuration in which the matching lower legs LL, LL' are separated permitting them to straddle the upper blade UB, as shown in FIGS. 3A and 3B.

Referring again to FIGS. 3A and 3B, the distal end of the upper leg UL of the front crank CF is pivotably supported by a fulcrum pin (threaded steel shoulder bolt) F1. Fulcrum pin (threaded steel shoulder bolt) F1 passes through and is secured to the upper cross members UC by a (hexagonal head steel bolt and and hexagonal nut arrangement) to the left of center of the upper cross members UC. The distal end of the upper leg UL' of rear crank CR is pivotably supported by the fulcrum pin (threaded steel shoulder bolt) F2 which is secured to the upper cross members UC, near the right end of the two upper cross members UC in the same way as pin (threaded steel shoulder bolt) F1. The lower blade LB is retained in a stationary position by the lower frame LF portion of the rigid frame FF as described in more detail below with reference to FIG. 4A.

Referring to FIG. 3A, tool 10 is shown in the open position. The blades UB and LB are separated by a distance of about one half (0.5) inch. The upper blade UB is driven down as the bell cranks CF and CR both rotate counterclockwise in unison so that the V-edge of the upper blade UB closes down against the V-edge of the lower blade LB, at the same time the upper blade UB moves farther to the left, producing a swinging motion in which the upper blade UB slides across the shingle SH pinching the shingle SH in a way which is highly effective for indenting and splitting an asphalt shingle.

Repeating some of the description from above, for clarification, the upper blade UB is swung down from its open position in FIG. 3A to its closed position in FIG. 3B in response to manually actuation in the counterclockwise direction to lower of the actuator handle HL by turning it about the pivot point P3. Handle HL has been cut away in FIG. 3A for convenience of illustration. Handle HL is secured, rotatably, at its lower end by fulcrum pin (threaded steel shoulder bolt) P5 to the top end T of right legs RL of the matching pair of rigid frames FF. Top end T extends well above upper cross member UC, high enough to provide good leverage upon the cranks CF and CR by transmitting force through a matched pair of rotating balanced steel links L2, L2' and a matched pair of reciprocating balanced steel links L1 and L1'. Crank pin (threaded steel shoulder bolt) P5 passes through handle HL, washers W (seen in FIG. 6) and a matched pair of balanced, rotating links L2, L2'. The crank pin P5 is located a slight distance up the lever arm of handle HL and crank pin (threaded steel shoulder bolt) P5 connects to the proximal (right hand) end of rotating balanced links L2, L2'. On the distal (left) ends of rotating balanced links L2, L2' the crank pin (threaded steel shoulder bolt) P2 connects the distal (left) end of rotating balanced links L2, L2' to both the proximal end of the upper leg UL of rear crank CR and to the proximal (right) end of the horizontally oriented, reciprocating balanced links L1, L1'. The distal (left) ends of reciprocating balanced links L1, L1' are connected by crank pin (threaded steel shoulder bolt) P1 to the proximal end of the upper leg UL' of front crank CF. To summarize, the tool 10 includes seven bearing pins with three fulcrum pins F1, F2, F3, and four additional linkage pins P1, P2, P3 and P4 which together with the balanced links and the frames and the bearing holes extending therethrough form bearings for the tool 10.

In operation, referring to FIG. 3B, the handle HL is gripped at the upper end and is rotated counterclockwise about fulcrum pin (threaded steel shoulder bolt) F3 counterclockwise to crank the rotating link L2 counterclockwise by a reduced radius with the great mechanical advantage of the shorter lever arm from fulcrum pin (threaded steel shoulder bolt) F3 to crank pin (threaded steel shoulder bolt) P5 along handle HL. The rotating links L2, L2' drive the two bell cranks CR and CF counterclockwise. The links L1, L1', which are horizontally oriented, reciprocate to transmit the drive force along further, to the crank CF as it moves lower towards the upper cross member UC. The two bell cranks CF and CR connect respectively through the lower legs thereof through pins (threaded steel shoulder bolts) P3 and P4 to drive the upper blade UB down and to the right in a swinging motion.

FIG. 4A shows a side elevational view of an embodiment of the tool 10 of FIGS. 1A and 1B with the blades in the open position, in accordance with this invention with the frame FF shown in supporting the blades UB and LB and the cranks CF and CR. Hexagonal nuts HN are shown which secure the fulcrum pins (threaded steel shoulder bolts) F1, F2, and F3 which pass through both of the frame halves FF and the pin P3. The ends of the threaded steel shoulder bolts F1, F2, and F3 are seen centered within the nuts HN. Hexagonal steel bolts HB are shown securing the frames FF together with threaded nuts (not shown) at the opposite ends, as will be well understood by those skilled in the art. The two matched rigid rectangular frames FF and the bottom steel bolts BB shown above feet F extend through the lower blade LB to hold the lower blade LB in fixed position by securing lower blade LB and the frames FF together. Bolts BB are located on the right and left ends of the bottom cross member BC. The top steel bolts TB shown above legs FL and RL extend through spacers, not shown, secure the tops of the frames FF together.

Referring again to FIG. 4A, threaded crank pins P1 and P2 are held in position by the upper two nuts UN which are shown secured thereto to hold the links L1 and L2 (plus L1' and L2' in FIG. 6, as described below) to the long arms of the bell cranks CF and CR. Threaded crank pins P3 and P4 are held in position by the lower two nuts LN to secure the lower legs LL of the bell cranks CF and CR to the upper blade UB as seen in FIG. 5B, as described below. The upper blade UB is reinforced to prevent deflection thereof under forces exerted by a shingle SH, by provision of a reinforcing angle bar RB secured thereto by steel bolts with hexagonal heads HR which are secured by threaded nuts (not shown), as will be well understood by those skilled in the art.

There are matching work supporting tables TBL which are provided on the left side of the tool 10 (adjacent to the front legs FL) with a horizontal flat surface for supporting a shingle SH. The surface of the table TBL is just below the level of the edge UE of the lower blade LB.

Figure 4B:
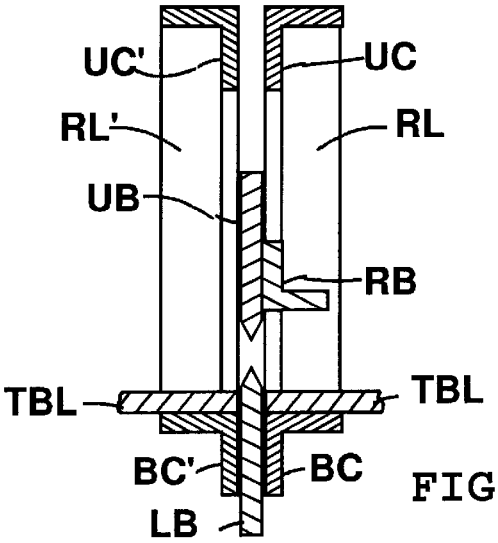
FIG. 4B shows a sectional view of the tool of FIG. 4A taken along line 4B–4B' in FIG. 4A.

FIG. 4B shows a sectional view of the tool 10 of FIG. 4A taken along line 4B—4B' in FIG. 4A. At the upper end are cross sections of the upper cross members UC, UC'. At the lower end are cross sections of the bottom cross members BC' and BC. The rear legs RL' and RL are shown in the background to complete the connection between the upper cross members UC' and UC to the bottom cross members BC' and BC although they are far in the background behind line 4B–4B' in FIG. 4A. Cross sections of the upper blade UB and the lower blade LB are shown in end views as in FIG. 2A. The two halves BF' and BF of the bottom frame are shown sandwiched on either side of lower blade LB showing how the bottom frames hold the lower blade LB between them preventing deflection or bending thereof because they are bolted together by the two bottom steel bolts BB, and the two top steel bolts TB as described above not shown in FIG. 4B.

Figure 4C:
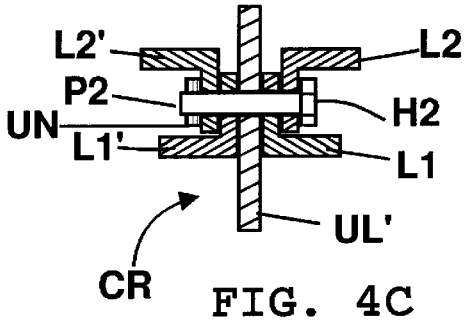
FIG. 4C shows a sectional view of the tool of FIG. 4A taken along line 4C–4C' in FIG. 4A.

FIG. 4C shows a sectional view of the tool 10 of FIG. 4A taken along line 4C–4C' in FIG. 4A showing how the rotating balanced links L2, L2' and the reciprocating balanced links L1 and L1' are interconnected to the proximal end of the upper leg UL' of rear bell crank CR by threaded pin P2 with head H2 on the right and fastened to threaded nut UN on the left. Rear crank CR is sandwiched between the proximal ends of reciprocating balanced links L1 and L1' which have an L-shaped cross-section. In turn, the proximal ends of reciprocating balanced links L1 and L1' are sandwiched between the distal ends of the rotating balanced links L2, L2' with pin P2 passing therethrough.

Figure 6:
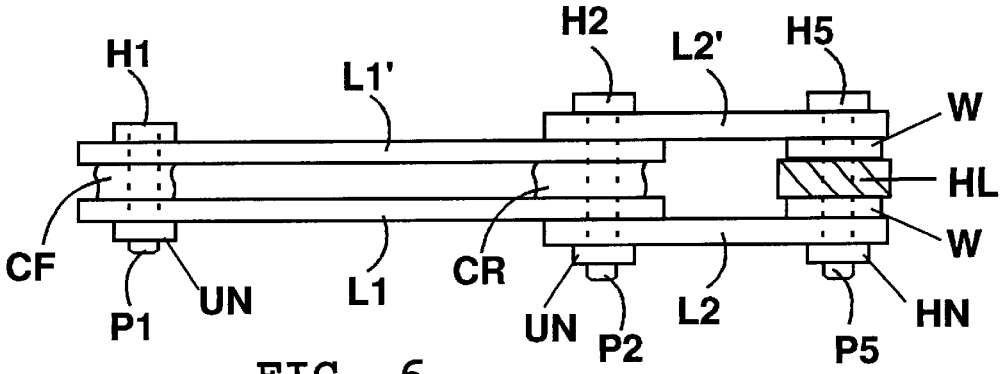
FIG. 6 shows a plan view of a portion of the tool of FIG. 4A showing a sectional view of the actuator handle and the balanced linkages for driving a pair of bell cranks shown in FIGS. 3A, 3B, and FIG. 4A.

FIG. 5A shows a side elevational view of an embodiment of the rear bell crank CR of FIG. 4A in accordance with this invention. The other bell crank CF is identical to bell crank CR. At the proximal end of the upper leg is a bearing hole A1 which receives the pin P2 which extends through the balanced links L1', L2', L1 and L2 as seen in FIG. 4C (the crank CF is in the center, as shown in FIG. 6). At the distal end of upper leg UL' is located a fulcrum bearing hole A2 which is a hole extending through the thickness of the upper leg UL'. The lower legs LL and LL' (FIG. 5B) of crank CF are formed at right angles to the upper leg and extend from the proximal end of upper leg UL'. At the distal ends of lower legs LL are bearing holes A3 which extend through the thicknesses of the upper legs LL to receive the pin P4 through the upper blade UB.

FIG. 5B shows an end elevational view of the bell crank of FIG. 5A with a portion of the upper blade between the legs of the bell crank. As stated above, the lower legs LL, LL' of cranks CF and CR have a wishbone configuration in which the matching lower legs LL, LL' are separated permitting them to straddle the upper blade UB, as shown in FIGS. 5A, 3A, 3B and 4A. Referring again to FIG. 5A, this permits connection of blade UB and legs LL, LL' by the passage of pin P4 through bearing holes A3 and a matching bearing hole through the thickness of upper blade UB.

FIG. 6 shows a plan view of a portion of the tool 10 of shown in FIGS. 3A, 3B, and FIG. 4A showing a sectional view of the actuator handle HL and the top edges of balanced linkages L1, L1', L2 and L2' connected by pins P1 and P2 for driving the bell cranks CF and CR, of which fragments are illustrated. Handle HL is secured to links L2' on top and L2 on the bottom by a fulcrum pin (threaded steel shoulder bolt) P5 which preferably is a steel shoulder bolt with a hexagonal head H5 which is secured in position by nut HN. Between handle HL and each of the links L2' and L2 is located a spacer washer W to compensate for the extra thickness of crank CR and the balanced links L1, L1', L2 and L2' which are held together by pin P2 (threaded steel shoulder bolt with a hexagonal head H2) which is secured in position by nut UN. Link L1', crank CF and link L1 are held together by pin P1 (threaded steel shoulder bolt with a head hexagonal H1) which is secured in position by another nut UN.

SUMMARY

A shingle trimmer made in accordance with this invention permits far easier trimmer than can be done with a hand held utility knife. I have discovered that at high temperatures, when the asphalt shingles become softer and gummy, the use of a set of blades with a simple pinch effect will cause the blades to gum up to some degree, but that with the enhanced combined sliding motion of the pinch blades of this invention, the problem of gumming up the blades is overcome. When the shingles are at low, cold temperatures, with the tool of this invention, the shingles split rather easily as contrasted to the result with a utility knife which make it extremely difficult to cut the shingles.

While this invention has been described in terms of the above specific embodiment(s), those skilled in the art will recognize that the invention can be practiced with modifications within the spirit and scope of the appended claims, i.e. that changes can be made in form and detail, without departing from the spirit and scope of the invention. Accordingly all such changes come within the purview of the present invention and the invention encompasses the subject matter of the claims which follow.

What is claimed is:

1. A trimming tool comprising:

a stationary blade with a stationary edge, a movable blade with a reciprocable edge, means for supporting said stationary blade and said movable blade, with said movable blade being supported by means for guiding combined arcuate movement comprising sliding perpendicular pinching movement with transverse movement of said movable blade whereby said movable blade slides closing along a combined transverse and perpendicular downward, arcuate path towards a closed position with said reciprocable edge in contact with said stationary edge without any overlapping of said movable blade and said stationary blade and whereby said movable blade slides away from said stationary blade in a reverse and upward arcuate path into an open position, said sliding action providing movement of said reciprocable edge into confrontation with said stationary edge for pinching work between said stationary blade and said movable blade to indent said work with the sliding of said movable blade, without a shearing action of said movable blade and said stationary blade.

2. A tool in accordance with claim 1 including:

said means for supporting including a pair of matched cranks including a front crank and a rear crank pivotably secured to said movable blade, and said movable blade remaining parallel to said stationary blade during an entire reciprocal path traversed by said movable blade from an open position to a closed position and back to said open position.

3. A tool in accordance with claim 1 including:

said means for supporting including a pair of matched cranks including a front crank and a rear crank pivotably secured to said movable blade, a support frame including an upper support member and a lower support member, said front crank and said rear crank being secured for cranking relative to said upper support member, and said stationary blade being secured to said lower support member.

4. A tool in accordance with claim 1 including:

said means for supporting including a pair of matched cranks including a front crank and a rear crank pivotably secured to said movable blade, a support frame including an upper support member and a lower support member, said front crank and said rear crank being secured for cranking relative to said upper support member, and said stationary blade being secured to said lower support member, and said front crank rotatably secured to said upper support member by a first fulcrum pin, and said rear rotatably secured to said upper support member by a second fulcrum pin.

5. A tool in accordance with claim 1 including:

said means for supporting including a pair of matched cranks including a front crank and a rear crank pivotably secured to said movable blade, each of said cranks including an upper arm and a pair of lower arms secured rotatably to said movable blade, said lower arms straddling said movable blade.

6. A tool in accordance with claim 1 including:

said means for supporting including a pair of matched cranks including a front crank and a rear crank pivotably secured to said movable blade, each of said cranks including an upper arm and a pair of lower arms secured rotatably to said movable blade, said lower arms straddling said movable blade, an actuating lever for said tool secured to said means for supporting, a matched pair of balanced linkages connected to opposite sides of said lever and to opposite sides of said cranks for transmitting force from said lever to said movable blade with balanced force vectors, whereby forces tending to rack said movable blade away from direct confrontation with said stationary blade are restrained from racking of said blades.

7. A tool in accordance with claim 1 including:

means for preventing deflection of said blades, whereby said blades have said stationary edge and said reciprocable edge in confrontational alignment when said blades are in the closed position.

8. A tool in accordance with claim 1 including:

means for preventing deflection of said blades comprising a reinforcement bar for said movable blade and sandwiching of said stationary blade between frame members of said means for supporting, whereby said blades have said stationary edge and said reciprocable edge in confrontational alignment when said blades are in the closed position.

9. A tool in accordance with claim 8 including:

said frame members comprising right angle cross-section members composed of metal.

10. A shingle trimming tool including:

a stationary blade with a stationary edge, a movable blade with a reciprocable edge, means for supporting said stationary blade and said movable blade, with said movable blade being mounted for movement towards a closed position with said reciprocable edge in contact with said stationary edge and said movable blade moving away from said stationary blade into an open position with a sliding action providing movement of said reciprocable edge into confrontation with said stationary edge for pinching work between said stationary blade and said movable blade, said means for supporting including a pair of matched, bell cranks including a front bell crank and a rear bell crank pivotably secured to said movable blade, a support frame including an upper support member and a lower support member, said front crank and said rear crank being secured for cranking relative to said upper support member, and said stationary blade being secured to said lower support member, and said front crank rotatably secured to said upper support member by a first fulcrum pin, and said rear rotatably secured to said upper support member by a second fulcrum pin, each of said front bell crank and said rear bell crank having an upper leg and a lower leg connected together at a joint, with said front bell crank and said rear bell crank each having a structure as follows:

a) an upper cranking leg with a cranking end formed on the proximal end of said cranking leg, b) a fulcrum bearing hole located proximate to said joint with the corresponding one of said fulcrum pins located within said fulcrum bearing hole, and c) a lower cranked leg with output end on the distal end thereof, said first fulcrum pin and said second fulcrum pin being spaced apart by a first distance along said second support member, said proximal ends of said cranking legs being mounted rotatably to spaced apart points along a cranking linkage, said distal ends of said cranking legs being pivotably mounted by bearing pivot pins to said movable blade at pivot points spaced apart by said first distance.

11. A shingle trimming tool comprising:

a rigid rectangular frame having a parallel horizontal lower support member and a horizontal upper support member secured together by vertical members, a stationary blade having an edge with a V-shaped cross-section mounted on said lower support member, a pair of matched bell cranks including a front bell crank and a rear bell crank, said front bell crank rotatably secured to said upper support member by a first fulcrum pin, and said rear rotatably secured to said upper support member by a second fulcrum pin, each of said bell cranks including a cranking leg and a cranked leg connected together to a central bearing, each of said front bell crank and said rear bell crank having an upper leg and a lower leg connected together at a joint, a) an upper cranking leg with a cranking end formed on the proximal end of said cranking leg, b) a fulcrum bearing hole located proximate to said joint with the corresponding one of said fulcrum pins located within said fulcrum bearing hole, and c) a lower cranked leg with output end on the distal end thereof, said first fulcrum bearing pin and said second fulcrum bearing pin being spaced apart by a first distance along said upper support member, each of said proximal ends being mounted rotatably to spaced apart points along a cranking linkage, a movable blade having a V-shaped cross-section mounted for movement towards and away from said stationary blade, and each of said distal ends being pivotably mounted by bearing pivot pins to said movable blade at pivot points which are spaced apart by said first distance.

12. A method of making and operating a shingle trimming tool comprising the steps of:

providing a stationary blade with a stationary edge, providing a movable blade with a reciprocable edge, and supporting said stationary blade and said movable blade on a frame with said movable blade being mounted for movement of said reciprocable edge towards and away from said stationary edge with a sliding action and providing combined arcuate movement comprising sliding transverse movement combined with perpendicular pinching movement of said reciprocable edge closing along a combined transverse and perpendicular downward, arcuate path into a closed position confrontation with said stationary edge for pinching work between said stationary blade without any overlapping of said movable blade and said stationary blade, and sliding of said movable blade away from said stationary blade in a reverse and upward arcuate path into an open position, and placing a shingle in said tool and moving said movable blade down upon said shingle with said sliding movement to pinch said shingle between said stationary edge and said reciprocable edge to indent said shingle without any shearing action of said blades.

13. A method in accordance with claim 12 including the steps of:

securing said movable blade with a pivot to means for supporting including a pair of matched cranks including a front crank and a rear crank, and retaining said upper blade parallel to the lower blade during the entire reciprocal path traversed from open to closed position and back to the open position.

14. A method in accordance with claim 12 including the steps of:

securing said movable blade to pivot relative to means for supporting including a pair of matched cranks including a front crank and a rear crank, providing a support frame including an upper support member and a lower support member, securing said front crank and said rear crank for cranking relative to said upper support member, and securing said stationary blade to said lower support member.

15. A method in accordance with claim 12 including the steps of:

securing said movable blade for pivoting on means for supporting, said means for supporting including a pair of matched cranks including a front crank and a rear crank, providing a support frame including an upper support member and a lower support member, securing said front crank and said rear crank for cranking relative to said upper support member, and securing said stationary blade to said lower support member and rotatably securing said front crank to said upper support member by a first fulcrum pin, and rotatably securing said rear crank to said upper support member by a second fulcrum pin.

16. A method in accordance with claim 12 including the steps of:

supporting said movable blade with a pair of matched cranks including a front crank and a rear crank pivotably secured to said movable blade, rotatably securing each of said cranks including an upper arm and a pair of lower arms to said movable blade, with said lower arms straddling said movable blade.

17. A method in accordance with claim 12 including the steps of:

supporting said movable blade with a pair of matched cranks including a front crank and a rear crank pivotably secured to said movable blade, rotatably securing each of said cranks including an upper arm and a pair of lower arms to said movable blade, with said lower arms straddling said movable blade, providing an actuating lever for said tool secured to said means for supporting, employing a matched pair of balanced linkages connected to opposite sides of said lever and to opposite sides of said cranks for transmitting force from said lever to said movable blade with balanced force vectors, whereby forces tending to rack said movable blade away from direct confrontation with said stationary blade are restrained from racking of said blades.

18. A method in accordance with claim 12 including the step of:

providing means for preventing deflection of said blades, whereby said blades have said stationary edge and said reciprocable edge are in confrontational alignment when said blades are in the closed position.

19. A method in accordance with claim 12 including the step of:

providing means for preventing deflection of said blades comprising a reinforcement bar for said movable blade and sandwiching of said stationary blade between frame members of said means for supporting, whereby said blades have said stationary edge and said reciprocable edge in confrontational alignment when said blades are in the closed position.

20. A method in accordance with claim 12 including the step of: forming said frames from right angle cross-section metal members.

* * * * *